US011745034B2

(12) United States Patent
Seo et al.

(10) Patent No.: US 11,745,034 B2
(45) Date of Patent: Sep. 5, 2023

(54) POWERED AIR PURIFYING RESPIRATOR COMPOSING 2-CHANNEL STRUCTURE FOR AIR SUPPORT

(71) Applicant: SERVORE CO., LTD., Gyeonggi-do (KR)

(72) Inventors: Woon Su Seo, Gyeonggi-do (KR); Jeong Min Seo, Gyeonggi-do (KR)

(73) Assignee: SERVORE CO., LTD., Gyeonggi-do (KR)

( * ) Notice: Subject to any disclaimer, the term of this patent is extended or adjusted under 35 U.S.C. 154(b) by 473 days.

(21) Appl. No.: 16/692,361

(22) Filed: Nov. 22, 2019

(65) Prior Publication Data

US 2020/0164236 A1 May 28, 2020

(30) Foreign Application Priority Data

Nov. 23, 2018 (KR) ..... 10-2018-0145970

(51) Int. Cl.
*A62B 18/00* (2006.01)
*A62B 7/10* (2006.01)
(Continued)

(52) U.S. Cl.
CPC ..... *A62B 18/006* (2013.01); *A62B 7/10* (2013.01); *A62B 9/04* (2013.01); *A62B 18/025* (2013.01); *A62B 23/02* (2013.01)

(58) Field of Classification Search
CPC ..... A62B 18/00; A62B 18/003; A62B 18/006; A62B 18/02; A62B 18/025; A62B 18/04;
(Continued)

(56) References Cited

U.S. PATENT DOCUMENTS

2005/0103339 A1* 5/2005 Daly ..... A61M 16/0875 128/204.18
2007/0163587 A1* 7/2007 Teibel ..... A61M 16/107 128/204.18
(Continued)

FOREIGN PATENT DOCUMENTS

DE 102015005299 A1 * 10/2016 ..... A62B 7/12
KR 1020100013991 2/2010
(Continued)

OTHER PUBLICATIONS

English Machine Translation of WO-2017188792-A1 provided by PE2E (Year: 2017).*
(Continued)

*Primary Examiner* — Joseph D. Boecker
*Assistant Examiner* — Brian T Khong
(74) *Attorney, Agent, or Firm* — IPLA P.A.

(57) ABSTRACT

A powered air purifying respirator composing 2-channel structure for air support includes: a mask unit that is worn on a face to surround a mouth or nostrils of a user; a generator unit that causes outside air to flow in and supplies the air to the mask unit; and first and second connector units that are formed to provide channels of the air by being connected to the mask unit and the generator unit at both sides of the first and second connectors, where the generator unit includes a fan driving module having first and second air supply holes at both sides of the fan driving module, the first and second air supply holes communicating with end portions of the first and second connector units.

10 Claims, 6 Drawing Sheets

(51) Int. Cl.
*A62B 9/04* (2006.01)
*A62B 23/02* (2006.01)
*A62B 18/02* (2006.01)

(58) Field of Classification Search
CPC ..... A62B 18/045; A62B 18/10; A62B 23/00; A62B 23/02; A62B 7/00; A62B 7/02; A62B 7/10; A62B 9/00; A62B 9/02; A62B 9/04; A62B 9/06; A61M 2205/42
See application file for complete search history.

(56) References Cited

U.S. PATENT DOCUMENTS

| | | | | |
|---|---|---|---|---|
| 2012/0174922 | A1* | 7/2012 | Virr | A61M 16/106 128/206.28 |
| 2015/0314144 | A1* | 11/2015 | Virr | A62B 18/006 128/205.12 |
| 2016/0015916 | A1* | 1/2016 | Goff | A61M 16/0057 128/205.12 |
| 2017/0361134 | A1* | 12/2017 | Virr | A62B 18/082 |
| 2018/0296864 | A1* | 10/2018 | Feasey | A62B 18/025 |

FOREIGN PATENT DOCUMENTS

| | | | | |
|---|---|---|---|---|
| WO | WO-2013082650 | A1 * | 6/2013 | A61F 9/02 |
| WO | WO-2017188792 | A1 * | 11/2017 | A41D 13/11 |

OTHER PUBLICATIONS

English Machine Translation of DE-102015005299-A1 provided by PE2E (Year: 2016).*

* cited by examiner

POWERED AIR PURIFYING RESPIRATOR COMPOSING 2-CHANNEL STRUCTURE FOR AIR SUPPORT

CROSS REFERENCE

The present application claims priority to Korean Patent Application No. 10-2018-0145970, filed 23 Nov. 2018, the entire contents of which is incorporated herein by its entirety.

BACKGROUND

The present invention relates to a powered air purifying respirator composing 2-channel structure for air support, more specifically, to a powered air purifying respirator composing 2-channel structure for air support in which outside air is to be supplied to a mask unit simultaneously from connector units connected to both sides of the mask unit.

A welding is a metal processing that joins two or more solid metals into one. A high energy heat source is required for welding and high-pressure and explosive gases such as high voltage electricity, oxygen, acetylene, and argon are used as the energy source. The hazards and dangers caused by the welding are due to welding fume (metal components contained in the fume), harmful gases, harmful rays, noise, or high temperature environment etc. generated during welding operation.

In particular, when an arc welding is performed in a narrow and closed work place, the welding workers are injured by the welding fumes and nitrogen oxides generated during the welding process. Recently, a pneumoconiosis (welding pneumonia) is caused by the fumes generated during welding operation and a manganese poisoning accident is caused by the use of electrodes in manganese. Accordingly, measures for health problems of welding workers are required.

The welding fume refers to a small particle formed by the cooling of a material evaporated by heat during welding operation and is caused by the diffusion of the molten metal vapor around by an arc generation heat of high temperature. In the relationship between the amount of the fume generated in the coated arc welding and the welding current, the greater the current, the voltage, and the electrode diameter, the greater the amount of generation thereof.

On the other hand, the harmful gas generated by welding has not been noticed as much as the welding fume and the recognition of the hazard thereof is lower than the welding fume. However, since there are various types of harmful gases such as ozone, nitrogen oxides, carbon monoxide, carbon dioxide, hydrogen fluoride, phosgene, phosphine, products by pyrolysis in painting and coating components, it must be as careful as the welding fumes.

Conventionally, in order to protect the workers from the harmful rays generated during arc and gas welding or cutting operations and to protect the workers from the risk of lacerated wound on the face and the neck caused by heat generated during welding and burns caused by debris such as heated materials etc., a lot of automatically shading welding mask have been used. Recently, there is a growing awareness of the importance of air purifying respirator as well as the light and heat shading means in hazardous workplaces. There is no institutional restriction on this, but there is an active movement of legislation recently.

In the case of the existing automatically shading welding mask, the welding fumes, the harmful dust, and the harmful smell and odor generated during the work cannot be blocked. Therefore, the powered air purifying respirator (welding mask air supply) for the purpose of preventing the user from inhaling the harmful fumes generated during the welding operation has been developed and supplied. However, the conventionally developed powered air purifying respirator is very expensive and has a very high negative factor in the market in terms of wear and activity thereof.

The general powered air purifying respirator includes an automatic welding mask, a motor, a battery, a hose, a blowing fan, a filter, etc. and is usually sold at a high price of about 100 to 1.5 million won. That is, because the filter body of the powered air purifying respirator is connected to the automatic welding mask through the hose and continuously supplies a certain amount of purifying air to the automatic welding mask, the motor, the battery, and the filter etc. are quite large and very expensive.

In the case of the powered air purifying respirator, in the workplace where the welding fumes, the harmful dusts, and the harmful smells and odors occur and the place where the respiratory infectious diseases occur, the external air contaminated is sucked by its own power and filtered by the filter and then, the filtered air is supplied to the worker. However, the conventional powered air purifying respirator has problems in that the filter body is worn on the back of the waist and the long hose is connected to the automatic welding mask so it is inconvenient to wear owing to the big volume and weight, and the hose is long so it is limited in the activity thereof in the worn state.

FIG. 1 is a view showing a simple structure of a conventional powered air purifying respirator for solving the above problems. As shown, the conventional powered air purifying respirator includes a mask portion (100) for wearing on the face of the worker, a generator portion (200) that is disposed on the rear nape side of the worker and supplies the filtered outside air to the mask portion (100), and first and second connectors (310, 320) connected to both sides of the mask portion (100) and the generator portion (200) for providing passages of the filtered air.

In the conventional powered air purifying respirator, the external air introduced from the generator portion (200) is transferred to the mask portion (100) through the first connector portion (310) and the remaining air discharged through the breath from the mask portion (100) is discharged backward through the second connector portion (320), so that the breathing is performed while the outside air is moved in one direction.

As such, in the conventional powered air purifying respirator, the air is supplied from the first connector portion (310) and the exhaust air containing carbon dioxide through the respiration is discharged to the outside through the front of the mask portion (100) and the second connector portion (320). At this time, the remaining air, that is not discharged to outside, remains inside the second connector portion (320), so that the worker can frequently inhale the air containing a large amount of carbon dioxide inside the second connector portion (320).

Further, in the conventional powered air purifying respirator, the air is supplied thereto in only one direction, so that the filter (210) installed in the inlet (201) of the generator portion (200) is severely contaminated only in a portion adjacent to the first connector portion (310), thereby shortening the filter life.

Moreover, in order to supply air smoothly, the width of the air passage inside the first connector portion (310) should be fairly wide. Further, in order to rapidly supply the air thereto, there is a problem in that the driving load of a fan motor (225), which is installed in the generator portion (200), is increased.

Moreover, the generator portion (200) and the connector portions (310, 320) are generally manufactured by a plastic injection method, so that the airtightness of the connection part cannot be guaranteed and the pressure loss inside the air passage is inevitably generated. As a result, the load of the fan motor becomes great and a smooth air supply is not achieved without a complete seal at the connection part thereof.

Accordingly, a demand for powered air purifying respirator capable of overcoming an unreasonable point according to the one-way air supply method of the conventional powered air purifying respirator and increasing the efficiency of the external air supply has been increased.

Patent Literature: Korean Patent Registration No. 10-1031818 (May 21, 2011)

SUMMARY OF THE INVENTION

The invention is made in order to solve the problem described above, and an object of the invention is that stable breathing takes place by minimizing a residual amount of carbon dioxide contained in air inside a tube such that outside air is supplied simultaneously to both sides of a mask unit in which respiration takes place.

Another object of the invention is to prevent a loss of a pressure in an air channel by enabling internal airtightness of an air flow channel to be maintained.

Still another object of the invention is to maintain air flow to a mask unit by sensing a change in pressure in the air flow channel in real time.

According to an aspect of the invention to achieve the object described above, there is provided a powered air purifying respirator composing 2-channel structure for air supply, including: a mask unit that is worn on a face to surround a mouth or nostrils of a user; a generator unit that causes outside air to flow in and supplies the air to the mask unit; and first and second connector units that are formed to provide channels of the air by being connected to the mask unit and the generator unit at both sides of the first and second connector units, wherein the generator unit includes a fan driving module having first and second air supply holes at both sides of the fan driving module, the first and second air supply holes communicating with end portions of the first and second connector units, respectively, and wherein the air flowing into the inside through the generator unit is supplied to both the first and second connector units, and the air supplied both sides of the mask unit is discharged outside through a discharge hole formed in the mask unit.

Preferably, the fan driving module includes a housing having an inlet hole at one side surface and an accommodation space at an inner side, the inlet hole being formed to cause air to flow into the generator unit, a motor installed at one side of the housing, and a suction fan that is coupled to a rotary shaft of the motor to integrally rotate with the motor and suction the air flowing into the inlet hole; and the first and second air supply holes are formed in opposite directions to each other at an outer surface of the housing, and the air suctioned into the suction fan is caused to flow to the first and second connector units at a constant air pressure along the first and second air supply holes.

Preferably, the suction fan has rotary vanes, which curve in one direction on a disk and are radially formed, so as to form a flow current of air suctioned into the suction fan in one direction to an outer side, and the fan driving module has first and second extension pipes which are extended in a direction corresponding to the flow current of the air by the rotary vanes are formed in opposite directions to each other at the outer surface of the housing.

Preferably, end portions of the first and second connector units have first and second coupling pipes communicating with air channels of the first and second connector units are protruded and are integrally formed to the first and second connector units, respectively, by plastic injection molding, and the first and second extension pipes are integrally foamed to the housing by plastic injection molding; and the powered air purifying respirator further comprises first and second rubber elastic tubes having ends at one side tightly coupled to respective outer edges of the first and second extension pipes, and ends at another side tightly coupled to respective outer edges of the first and second coupling pipes, such that air flowing into the generator unit is supplied to the first and second connector units.

Preferably, at least one sealing protrusion is formed to project along outer edges at end portions of the first and second connector units and the first and second extension pipes to which the first and second elastic tubes are coupled.

Preferably, the first and second connector units have at least one pressure sensing unit that is provided inside the air channel and senses a pressure in the air channel; and, when the pressure is lowered to a pressure equal to or lower than a preset pressure based on a value sensed by the pressure sensing unit, the fan driving module operates such that air inside the air channel is discharged outside through the mask unit.

BRIEF DESCRIPTION OF THE DRAWINGS

The above and other objects, features and advantages of the present invention will be more apparent from the following detailed description taken in conjunction with the accompanying drawings, in which.

REFERENCE SIGNS LIST

Figure 1:
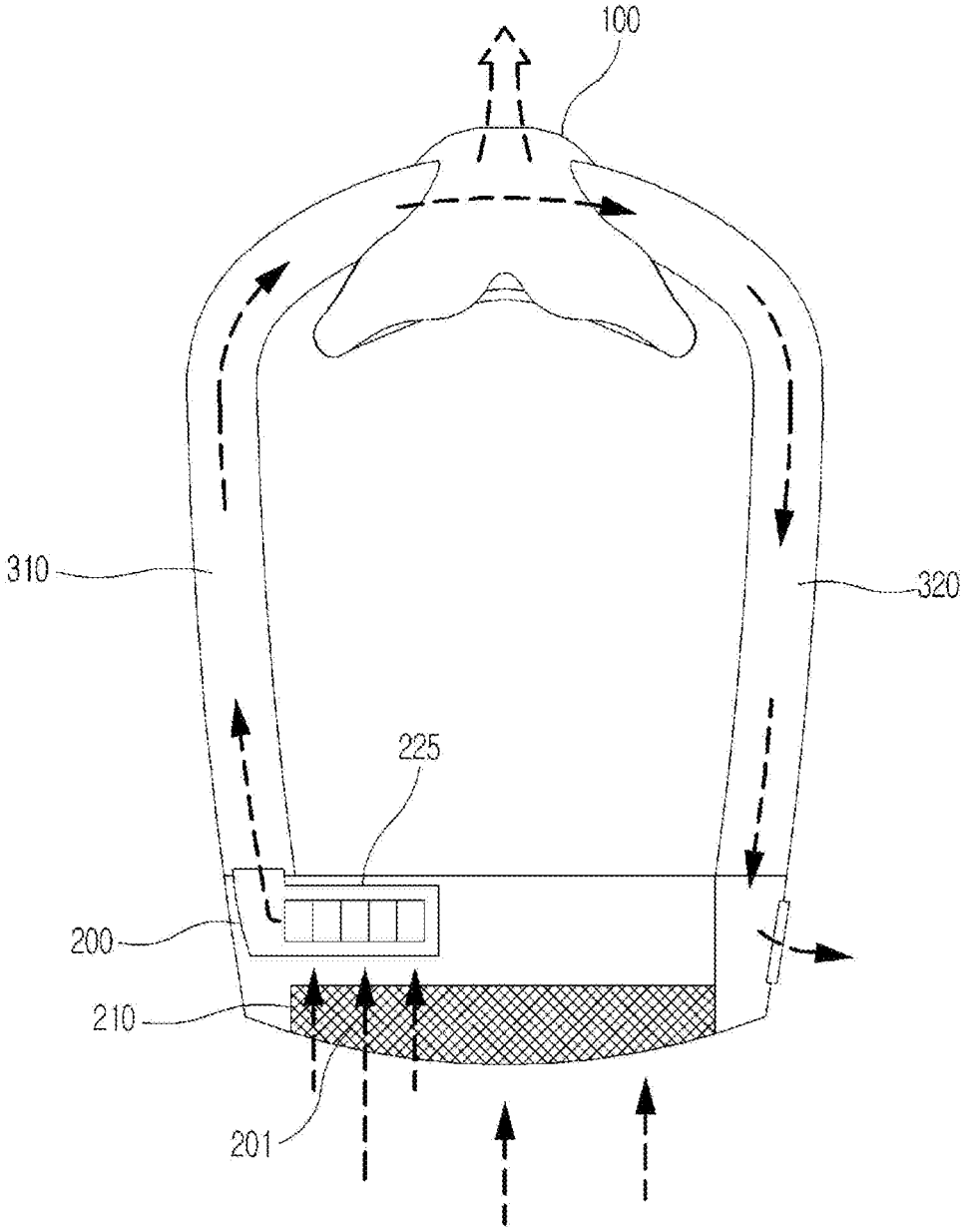
FIG. 1 Prior Art
FIG. 1 is a view showing a simple structure of a conventional powered air purifying respirator.

100: mask unit
110: discharge hole
200: generator unit
201: air supply grill
210: filtering module
220: fan driving module
221: housing
**221*a***: first extension pipe
**221*b***: second extension pipe
**221*c***: inlet hole
**222*a***: first air supply hole
**222*b***: second air supply hole
223: rubber gasket

224: rubber elastic cover
225: motor
226: suction fan
226*a*: rotary vanes
310: first connector unit
311: first coupling pipe
320: second connector unit
321: second coupling pipe
221-1, 310-1: sealing protrusion
410: first elastic tube
420: second elastic tube
500: pressure sensing unit

DETAILED DESCRIPTION OF THE PREFERRED EMBODIMENT

Hereinafter, the invention will be described in more detail with reference to the accompanying drawings.

Figure 2:
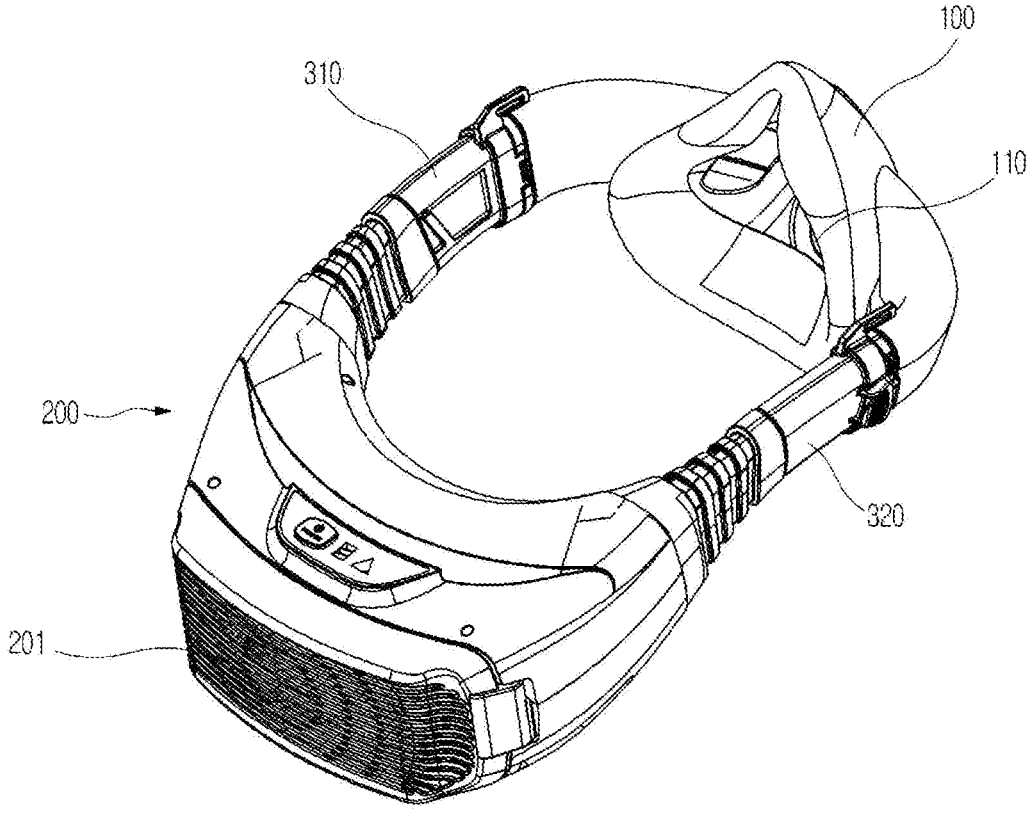
FIG. 2 is a perspective view illustrating the external appearance of a powered air purifying respirator composing 2-channel structure for air supply according to the invention.
Figure 3:
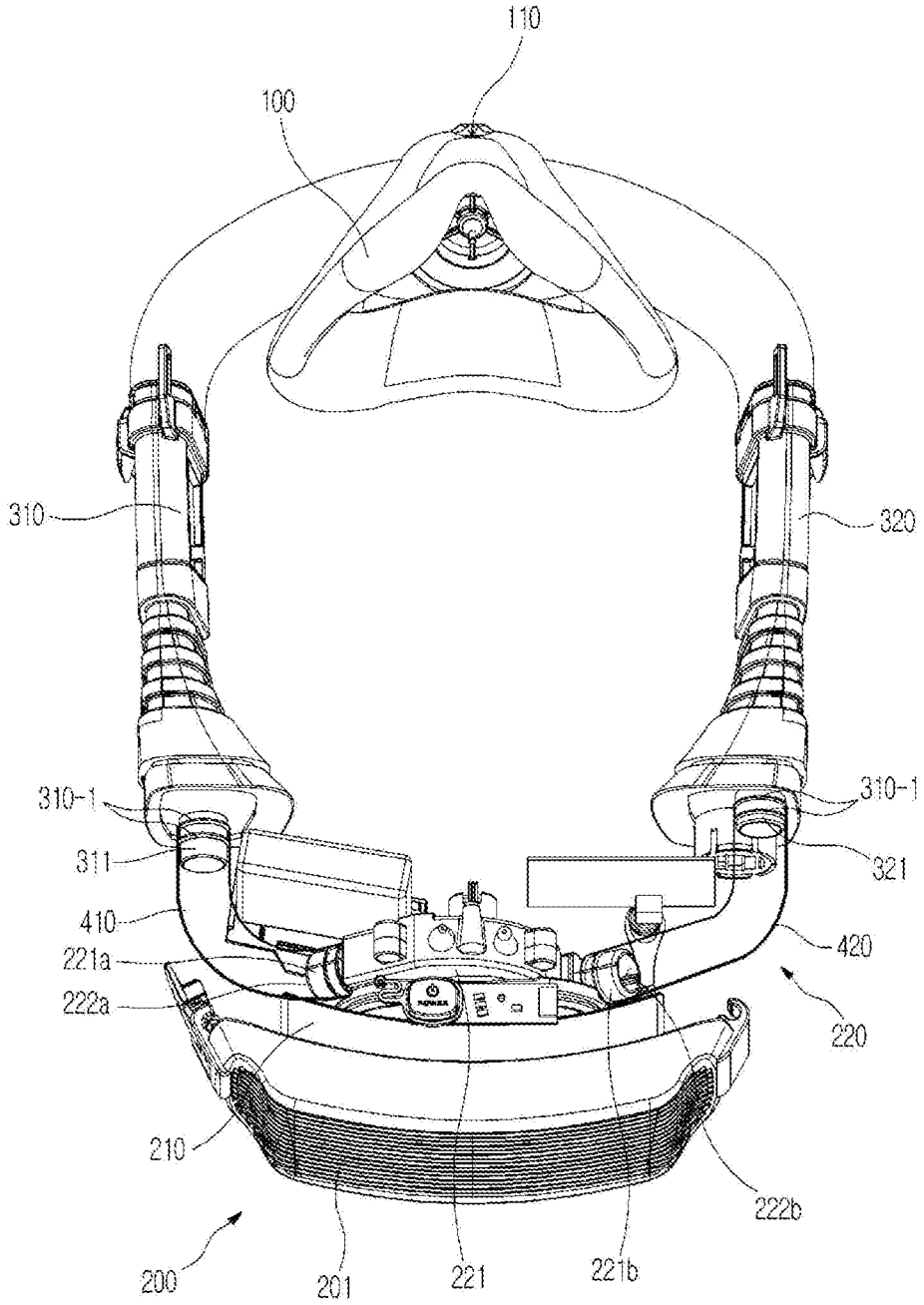
FIGS. 3 and 4 are views illustrating an internal structure of the powered air purifying respirator composing 2-channel structure for air supply in a state where a cover of a generator unit according to the invention is partially removed.
Figure 4:
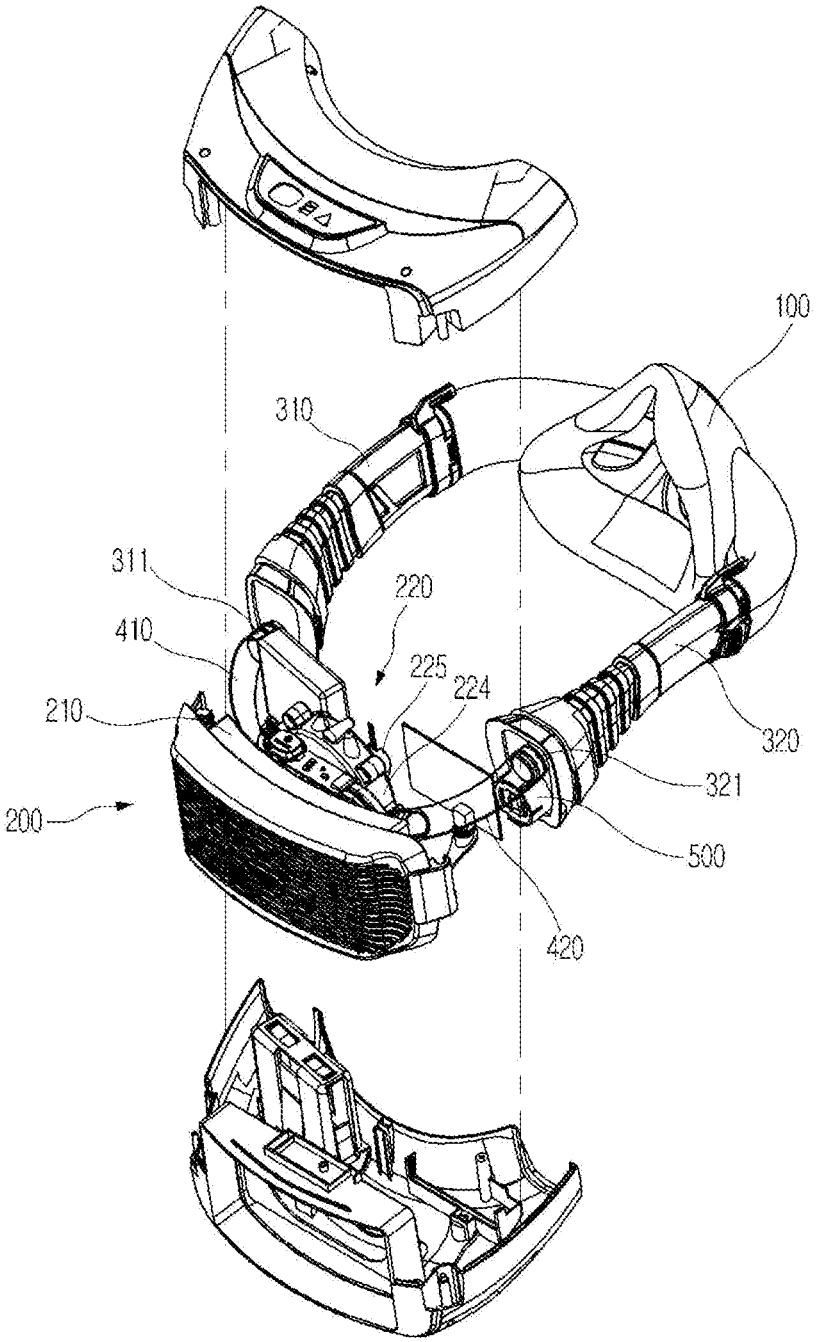
Figure 5:
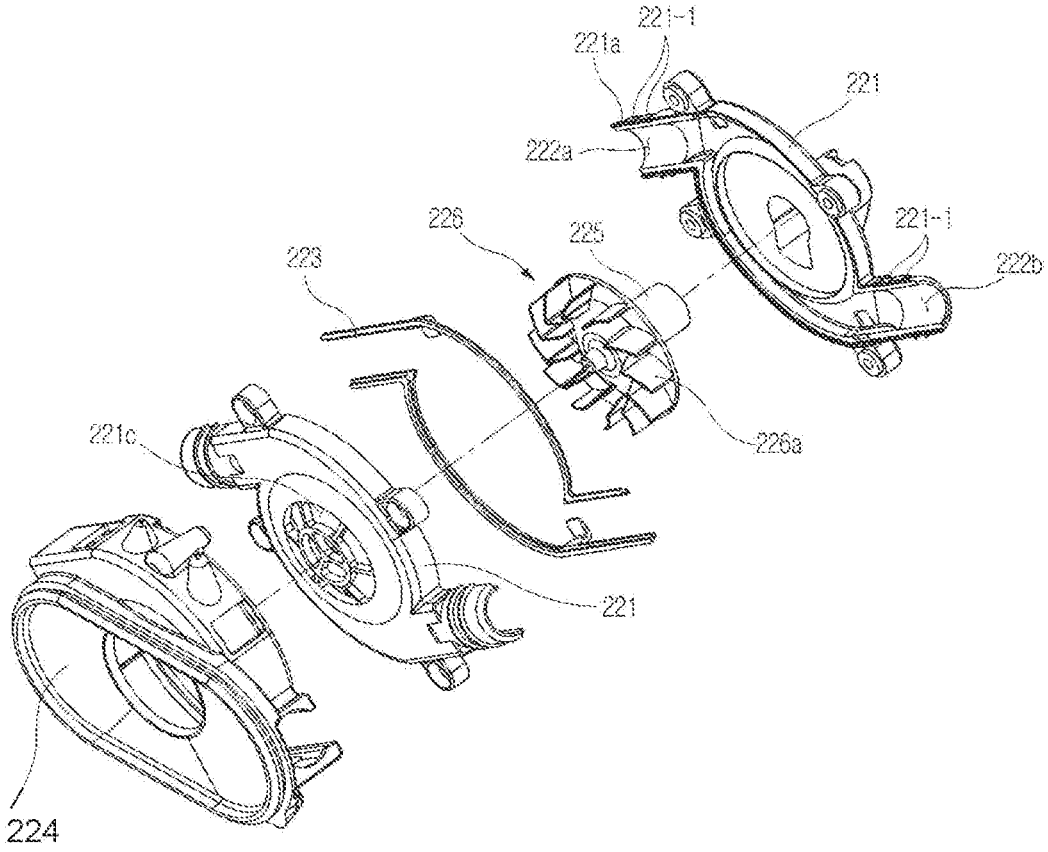
FIG. 5 is an exploded partial perspective view of a fan driving module according to the invention.

FIG. 2 is a perspective view illustrating the external appearance of a powered air purifying respirator composing 2-channel structure for air supply according to the invention. FIGS. 3 and 4 are views illustrating an internal structure of the powered air purifying respirator composing 2-channel structure for air supply in a state where a cover of a generator unit according to the invention is partially removed. FIG. 5 is an exploded partial perspective view of a fan driving module according to the invention.

With reference to the drawings, the powered air purifying respirator composing 2-channel structure for air supply according to the invention is configured to include a mask unit (100), a generator unit (200), and first and second connector units (310 and 320).

The mask unit (100) is a part that is worn on a face to surround a mouth or nostrils of a user. Desirably, a part of the mask unit which directly surrounds the face is made of a soft material such as silicone or rubber. Basically, the mask unit is means for protecting a respiratory organ of the user from welding fume, hazardous dust, hazardous odor, or stink which is produced during work. The mask unit (100) has a discharge hole (110) formed at a front surface of the mask unit, and emitted air exchanged through breathing of the user is discharged from the discharge hole (110).

The first and second connector units (310 and 320) at one side are connected to both sides of the generator unit (200), respectively, and the other ends thereof are connected to both sides of the mask unit (100), respectively, such that a flow channel of air supplied from the generator unit (200) to the mask unit (100) is provided.

The generator unit (200) is disposed at a nape side of a neck of the user and has a function of causing outside air to flow in, filtering the outside air, and supplying the filtered air to the mask unit (100). The generator unit is provided to have an air supply grill (201) that is formed to be elongated in a transverse direction at a rear side and is provided to cause outside air to flow into the inside, a filtering module (210) that filters air flowing in from the air supply grill (201), and a fan driving module (220) that suctions air purified through the filtering module (210) and causes the air to move to both the first and second connector units 310 and 320.

Here, the fan driving module (220) has first and second air supply holes (222*a* and 222*b*) which communicate with end portions of the first and second connector units (310 and 320) at one side, respectively, and the fan driving module (220) is configured to include a housing (221), a motor (225), and a suction fan (226).

The housing (221) has an inlet hole (221*c*) formed at one side surface at the rear side, and the air that flows in from the air supply grill (201) and is purified through the filtering module (210) is caused to flow into an inside of the housing (221) through the inlet hole (221*c*). Besides, the housing (221) has a circular accommodation space separately such that the motor (225) and the suction fan (226) are installed in the inside.

The motor (225) is installed at one side of the housing (221), and the suction fan (226) is shaft-coupled to a rotary shaft of the motor (225) to integrally rotate and suction the air flowing into the inlet hole (221). The suction fan (226) is installed on a central axis line corresponding to the inlet hole (221*c*) and has rotary vanes (226*a*) which curve in one direction on a disk and are radially formed to project.

Hence, while the suction fan rotates by the motor (225), a flow current of air suctioned by the rotary vanes (226*a*) is foiled outward in one direction, and an outer surface of the housing (221) has first and second extension pipes (221*a* and 221*b*), which are formed in opposite directions to each other, in a direction corresponding to the flow currents of the air by the rotary vanes (226*a*).

Besides, the first and second air supply holes (222*a* and 222*b*) formed at the first and second extension pipes (221*a* and 221*b*), respectively, are coupled to respective end portions of the first and second connector units (310 and 320) at one side so as to communicate with the end portions such that driving of the suction fan (226) causes outside air to flow into insides of the first and second connector units (310 and 320) at a constant pressure along the first and second air supply holes (222*a* and 222*b*).

Also, end portions of the first and second connector units (310 and 320) have first and second coupling pipes (311 and 321), respectively, which are formed to project and communicate with internal air channels of the first and second connector units (310 and 320), and thus the generator unit (200) is not directly connected to the end portions of the first and second connector units (310 and 320) at one side but is indirectly connected thereto via first and second elastic tubes (410 and 420).

The first and second elastic tubes (410 and 420) are made of a rubber material having certain elasticity, outer edges of end portions of the first and second extension pipes (221*a* and 221*b*) are tightly inserted into end portions of the first and second elastic tubes at one end, and outer edges of end portions of the first and second coupling pipes (311 and 321) are tightly inserted into end portions of the first and second elastic tubes at the other end. Hence, airtightness of a connection site is maintained by the elastic tubes, and thus leaking of air is minimized.

In general, when parts formed by plastic injection molding are connected to each other to have a function as the internal air flow channel like that in the invention, air is likely to leak through a gap in a connection portion, and thus it is not possible to maintain airtightness. Here, in order to maintain the airtightness, a rubber gasket or the like is separately installed at the connection portion, and then it is possible to maintain the airtightness; however, in order to install the rubber gasket, complex molding work has to be accompanied at the connection portion, and a worker has to perform cumbersome work of inserting the rubber gaskets one by one into a mold.

In this respect, in the invention, as described above, the first and second connector units (310 and 320), to which the first and second coupling pipes (311 and 321) are integrally formed at the end portions of the first and second connector units, and the housing (221), to which the first and second extension pipes (221*a* and 221*b*) are integrally formed, are to be formed by a general plastic injection method, and end portions of the first and second coupling pipes (311 and 321) and the first and second extension pipes (221*a* and 221*b*) are simply inserted into the first and second elastic tubes (410 and 420) such that a molding and assembly process is simplified and the airtightness in the air flow channel is maintained by the elastic tubes.

Also, at least one sealing protrusion (221-1 or 310-1) is formed to project along outer edges at end portions of the first and second extension pipes (221*a* and 221*b*) and first and second coupling pipes (311 and 321) which are tightly coupled to the first and second elastic tubes (410 and 420), and thereby the airtightness is maintained by the sealing protrusions (221-1 or 310-1) such that air does not leak outside at the connection portion in an air flow process.

Further, the housing 221 has a structure in which front and rear cases are separated from each other, an accommodation space, in which the motor (225) is accommodated, is formed in the front case, the inlet hole (221*c*) is formed at the rear case, and a rubber gasket (223) is installed along a connection portion of the rear case such that the airtightness inside the housing 221 is to be maintained.

Besides, a rubber elastic cover (224) having a shape corresponding to a shape of the outer shape of the housing (221) is tightly coupled to the outer surface of the housing (221) such that the airtightness is to be maintained, and vibration and noise occurring due to an operation of the motor (225) is to be reduced.

In addition, in the invention, the first and second connector units (310 and 320) have at least one pressure sensing unit (500) that is provided inside the air channel and senses a pressure in the air channel.

The pressure sensing unit (500) can sense an internal pressure by using a sensor such as a hole magnetic sensor. Then, when a value sensed by the pressure sensing unit (500) is lowered to a value equal to lower than a preset pressure, a drive control unit (not illustrated) operates the fan driving module (220), to increase an internal pressure such that air in the air channel is discharged outside. Hence, the pressure in the air channel is prevented from being lowered to a negative pressure, and air emitted by breathing of the user is prevented from staying in the pipes.

In the invention, the second coupling pipe (321) is formed to project at a side wall surface which is a part of the end portion of the second connector unit (320), and the pressure sensing unit (500) is installed at a lower side-wall surface of the second coupling pipe (321). In this manner, the pressure sensing unit (500) is installed at a side of the end portion of the second connector unit (320) so as not to disturb the flow of air by disposition, and the pressure sensing unit can smoothly sense the internal pressure.

Hereinafter, an operation of the powered air purifying respirator composing 2-channel structure for air supply according to the invention will be described further in detail.

Figure 6:
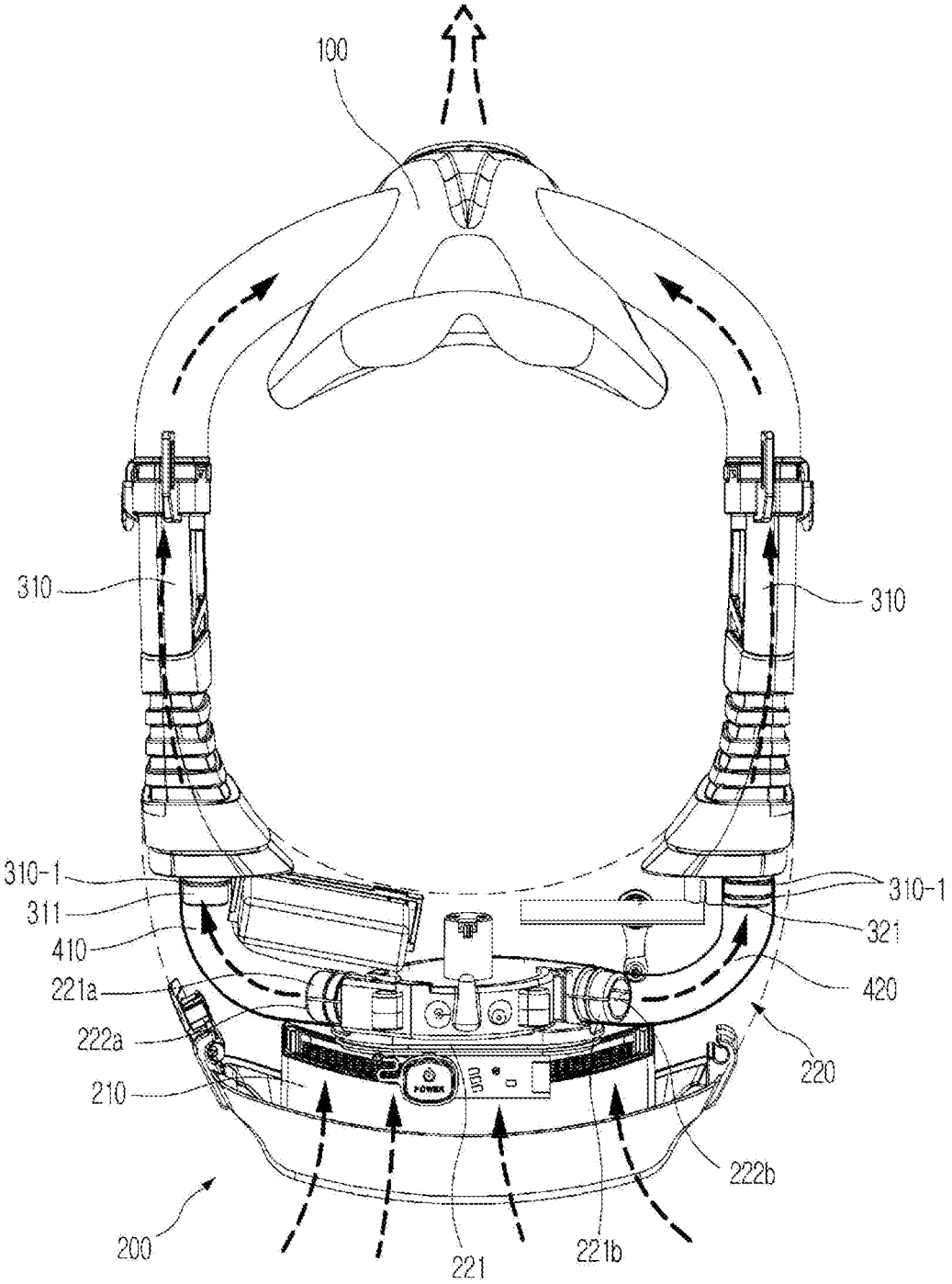
FIG. 6 is a view schematically illustrating a flow path of air in the powered air purifying respirator composing 2-channel structure for air supply according to the invention.

FIG. 6 is a view schematically illustrating a flow path of air in the powered air purifying respirator composing 2-channel structure for air supply according to the invention.

With reference to the drawing, when a power switch is turned on, and the powered air purifying respirator comes into an operation state, the drive control unit (not illustrated) drives the motor (225), and the suction fan (226) operates. When the suction fan (226) operates, outside air flows into the inside through the air supply grill (201) foiled in the generator unit (200) due to a suction pressure of the suction fan (226), the air flown in is purified through the filtering module (210) by removing contaminants, and the purified outside air is suctioned into the suction fan (226) through the inlet hole (221*c*) formed in the housing (221) of the fan driving module (220).

The rotary vanes (226*a*) of the suction fan (226) causes a flow current of the outside air suctioned into the inside of the housing (221) to be formed in one direction from the center of the suction fan (226) toward an outer side, and the air moves to the outer side through the first and second extension pipes (221*a* and 221*b*) formed in directions corresponding to the flow current.

In this manner, the air moving to both the first and second extension pipes (221*a* and 221*b*) moves into the first and second coupling pipes (311 and 321) via the first and second elastic tubes (410 and 420), and air is supplied to two channels at both sides of the mask unit (100) via the first and second connector units (310 and 320).

The air supplied to both sides of the mask unit (100) is inhaled by the user, and then air containing carbon dioxide emitted through breathing is to be discharged outside through the discharge hole (110) formed at the front surface of the mask unit (100).

In this manner, outside air is supplied to two channels of the mask unit (100) at both sides, air from the breathing is to be discharged to the front surface of the mask unit (100), and the discharged air containing carbon dioxide is prevented from staying inside the first and second connector units (310 and 320) connected to both sides of the mask unit (100). Further, the pressure sensing unit (500) is installed in the internal air channels of the first and second connector units (310 and 320), and when the pressure in the internal air channel is lowered to the negative pressure, the fan driving module (220) operates to discharge air to the mask unit (100). Consequently, it is possible to minimize a residual amount of air containing carbon dioxide inside the air channel.

Also, the air is supplied to both sides of the mask unit (100), and thereby a drive load of the motor (225) can be more reduced than in an air supply structure in which air is supplied in one direction. Further, the air can be smoothly supplied to the mask unit (100) without a need to increase pipe diameter of the internal air channels of both the first and second connector units (310 and 320), and particularly air is supplied in both directions as described above. Hence, the residual amount of carbon dioxide in the air channel can be minimized, and thus stable breathing can take place.

In addition, the equipment has advantages in that a service life cycle of the filter becomes longer than that of a one-direction air supply structure in which one side surface of the filter is contaminated, and filter purification capacity improves in both directions.

According to the invention described above, a user is to inhale the air which is simultaneously supplied from the first and second connector units connected to both sides of the mask unit, and air containing carbon dioxide emitted by breathing is discharged from the discharge hole at a front surface of the mask unit such that a residual amount of carbon dioxide in the air inside the air channels of the first and second connector units is minimized. The pressure sensing unit that senses a change in pressure inside the air flow channel is installed on a surface of a side wall at the end portion of the second connector unit and senses an internal pressure in real time without disturbing airflow. Hence, the following effects are achieved. When the internal pressure is lowered to a negative pressure, the suction fan operates such that the air can be smoothly discharged to the mask unit without staying inside, and thus stable breathing can take place.

In addition, the air can be smoothly supplied to the mask unit without an increase in pipe diameter of the internal air channels of both the first and second connector units, and thus the following effects are achieved. It is possible to reduce a drive load of the motor for supplying air, a service life cycle of a filter becomes longer than that of a one-direction air supply structure in which contamination occurs at one side surface of the filter, and filter purification capacity improves in both directions such that equipment is highly efficiently used.

In addition, the generator unit and the first and second connector units are not directly connected to each other but are tightly coupled to each other simply by the elastic tubes such that the air flow channels are indirectly connected to each other. Hence the following effects are achieved. An assembly process of a connection part is simplified, airtightness of a connection site is maintained, air is smoothly supplied, and thus a load of a fan driving motor is reduced such that the powered air purifying respirator can be stably used for a long time.

While the present invention has been described with respect to the specific embodiments, it will be apparent to those skilled in the art that various changes and modifications may be made without departing from the spirit and scope of the invention as defined in the following claims.

What is claimed is:

1. A powered air purifying respirator composing 2-channel structure for air supply, comprising:

a mask unit that is configured to be worn on a face to surround a mouth or nostrils of a user;

a generator unit that causes outside air to flow in and supplies the air to the mask unit; and first and second connector units that are formed to provide two respective air channels by being connected to the mask unit at one side of the first and second connector units and being connected to the generator unit at another side of the first and second connector units, wherein the generator unit includes a fan driving module having first and second air supply holes at both sides of the fan driving module, the first and second air supply holes communicating with an end portion of the first connector unit and with an end portion of the second connector unit, respectively, wherein the fan driving module comprises:

a housing having an inlet hole at one side surface and an accommodation space at an inner side of the housing, the inlet hole being formed to cause the air to flow into the generator unit, a motor installed at one side of the housing, a suction fan that is coupled to a rotary shaft of the motor to integrally rotate with the motor and suction the air flowing into the inlet hole, and a pressure sensing unit provided inside the air channel at the end portion of the second connector unit adjacent to the generator unit to sense a pressure in the air channel, wherein when the pressure is lowered to a pressure equal to or lower than a preset pressure based on a value sensed by the pressure sensing unit, the fan driving module operates such that that the air inside the air channel is discharged outside through the mask unit, wherein the mask unit includes first and second mask extension portions, wherein the first mask extension portion defines a first mask channel at one side of the mask unit and the second mask extension portion defines a second mask channel at another side of the mask unit, wherein the first connector unit is fluidly connected to the first mask extension portion and the second connector unit is fluidly connected to the second mask extension portion, wherein the air is supplied to the first and second mask channels via the first and second connector units, wherein the first and second air supply holes are formed in opposite directions to each other at an outer surface of the housing, and the air suctioned into the suction fan flows to the first and second connector units at a constant air pressure along the first and second air supply holes, wherein the suction fan has rotary vanes, which curve in one direction on a disk and are radially formed, so as to form a flow current of the air suctioned into the suction fan in one direction to an outer side of the housing, wherein the fan driving module has first and second extension pipes which are extended in a direction corresponding to the flow current of the air by the rotary vanes and are formed in opposite directions to each other at the outer surface of the housing, wherein the first and second extension pipes have smaller diameters than the first and second connector units, and wherein the air flowing into the inside of the respirator through the generator unit is supplied to both the first and second connector units, and the air supplied to both sides of the mask unit is discharged outside through a discharge hole formed in the mask unit.

2. The powered air purifying respirator composing 2-channel structure for air supply according to claim 1 further comprising an elastic cover, where the elastic cover is coupled to the outer surface of the housing.

3. The powered air purifying respirator composing 2-channel structure for air supply according to claim 1 further comprising a gasket, wherein the housing comprises front and rear cases, wherein the gasket is installed along a connection portion of the rear case.

4. The powered air purifying respirator composing 2-channel structure for air supply according to claim 1, further comprising a coupling pipe, wherein the coupling pipe is formed to project at a side wall surface which is a part of the end portion of the second connector unit, wherein the pressure sensing unit is installed at a lower side-wall surface of the coupling pipe.

5. The powered air purifying respirator composing 2-channel structure for air supply according to claim 1, wherein the end portions of the first and second connector units have first and second coupling pipes communicating with the air channels of the first and second connector units and are integrally formed to the first and second connector units, respectively, by plastic injection molding, and the first and second extension pipes are integrally formed to the housing by plastic injection molding, and wherein the powered air purifying respirator further comprises first and second rubber elastic tubes having ends at one side tightly coupled to respective outer edges of the first and second extension pipes, and ends at another side tightly coupled to respective outer edges of the first and second coupling pipes, such that the air flowing into the generator unit is supplied to the first and second connector units.

6. The powered air purifying respirator composing 2-channel structure for air supply according to claim 5, wherein the second coupling pipe is formed to project at a side wall surface which is a part of the end portion of the second connector unit, wherein the pressure sensing unit is installed at a lower side-wall surface of the second coupling pipe.

7. The powered air purifying respirator composing 2-channel structure for air supply according to claim 5, wherein at least one sealing protrusion is formed to project along outer edges at the end portions of the first and second connector units and along the outer edges of the first and second extension pipes to which the first and second elastic tubes are coupled.

8. A powered air purifying respirator composing 2-channel structure for air supply, comprising:

a mask unit that is configured to be worn on a face to surround a mouth or nostrils of a user;

a generator unit that causes outside air to flow in and supplies the air to the mask unit; and first and second connector units that are formed to provide two respective air channels by being connected to the mask unit at one side of the first and second connector units and being connected to the generator unit at another side of the first and second connector units, wherein the mask unit includes first and second mask extension portions, wherein the first mask extension portion defines a first mask channel at one side of the mask unit and the second mask extension portion defines a second mask channel at another side of the mask unit, wherein the first connector unit is fluidly connected to the first mask extension portion and the second connector unit is fluidly connected to the second mask extension portion, wherein the air is supplied to the first and second mask channels via the first and second connector units, wherein the generator unit includes a fan driving module having first and second air supply holes at both sides of the fan driving module, the first and second air supply holes communicating with an end portion of the first connector unit and with an end portion of the second connector unit, respectively, wherein the fan driving module comprises:

a housing having an inlet hole at one side surface and an accommodation space at an inner side of the housing, the inlet hole being formed to cause the air to flow into the generator unit, a motor installed at one side of the housing, and a suction fan that is coupled to a rotary shaft of the motor to integrally rotate with the motor and suction the air flowing into the inlet hole, and wherein the first and second air supply holes are formed in opposite directions to each other at an outer surface of the housing, and the air suctioned into the suction fan flows to the first and second connector units at a constant air pressure along the first and second air supply holes, wherein the suction fan has rotary vanes, which curve in one direction on a disk and are radially formed, so as to form a flow current of the air suctioned into the suction fan in one direction to an outer side of the housing, wherein the fan driving module has first and second extension pipes which are extended in a direction corresponding to the flow current of the air by the rotary vanes and are formed in opposite directions to each other at the outer surface of the housing, wherein the first and second extension pipes have smaller diameters than the first and second connector units, and wherein the air flowing into the inside of the respirator through the generator unit is supplied to both the first and second connector units, and the air supplied to both sides of the mask unit is discharged outside through a discharge hole formed in the mask unit.

9. The powered air purifying respirator composing 2-channel structure for air supply according to claim 8, wherein the end portions of the first and second connector units have first and second coupling pipes communicating with the air channels of the first and second connector units and are integrally formed to the first and second connector units, respectively, by plastic injection molding, and the first and second extension pipes are integrally formed to the housing by plastic injection molding, and wherein the powered air purifying respirator further comprises first and second rubber elastic tubes having ends at one side tightly coupled to respective outer edges of the first and second extension pipes, and ends at another side tightly coupled to respective outer edges of the first and second coupling pipes, such that the air flowing into the generator unit is supplied to the first and second connector units.

10. The powered air purifying respirator composing 2-channel structure for air supply according to claim 9, wherein at least one sealing protrusion is formed to project along outer edges at the end portions of the first and second connector units and along the outer edges of the first and second extension pipes to which the first and second elastic tubes are coupled.

* * * * *